US008049121B2

(12) United States Patent
Kleinlein et al.

(10) Patent No.: US 8,049,121 B2
(45) Date of Patent: Nov. 1, 2011

(54) CONTROL UNIT FOR A HOUSEHOLD APPLIANCE

(75) Inventors: Herbert Kleinlein, Oberasbach (DE); Lothar Knopp, Berlin (DE); Thomas Ludenia, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 327 days.

(21) Appl. No.: 12/308,011

(22) PCT Filed: May 22, 2007

(86) PCT No.: PCT/EP2007/054931

§ 371 (c)(1),
(2), (4) Date: Dec. 4, 2008

(87) PCT Pub. No.: WO2007/141136

PCT Pub. Date: Dec. 13, 2007

(65) Prior Publication Data

US 2009/0294265 A1 Dec. 3, 2009

(30) Foreign Application Priority Data

Jun. 9, 2006 (DE) ..... 10 2006 026 910

(51) Int. Cl.
*H01H 13/06* (2006.01)

(52) U.S. Cl. ..... 200/296; 200/302.1; 200/302.2; 200/341

(58) Field of Classification Search ..... 200/296, 200/302.1, 302.2, 341, 310, 313, 317, 5 R, 200/5 A, 511, 512
See application file for complete search history.

(56) References Cited

U.S. PATENT DOCUMENTS 4,555,600 A * 11/1985 Morse ..... 200/5 A
(Continued)

FOREIGN PATENT DOCUMENTS

CN 1713319 A 12/2005
(Continued)

OTHER PUBLICATIONS

International Search Report PCT/EP2007/054931.

*Primary Examiner* — Michael Friedhofer
(74) *Attorney, Agent, or Firm* — James E. Howard; Andre Pallapies

(57) ABSTRACT

The invention relates to control unit for a domestic appliance, especially for a washing machine with a fascia panel (10) to which is assigned at least one control button (16), indicator (18) or similar arranged within a panel opening (12, 14), with a board 22 for mounting at least one electrical or electronic component (24, 26, 28) arranged at a distance behind the fascia panel (10), and with a sealing element (34) arranged between the fascia panel (10) and the board (22) by means of which the at least one electrical or electronic component (24, 26, 28) is to be protected against water or similar, whereby the sealing element (34) is attached to the fascia panel (10) of the control unit.

19 Claims, 1 Drawing Sheet

U.S. PATENT DOCUMENTS

| | | | | |
|---|---|---|---|---|
| 5,258,592 | A * | 11/1993 | Nishikawa et al. | 200/302.2 |
| 5,614,702 | A * | 3/1997 | Kraft et al. | 235/145 R |
| 5,746,307 | A * | 5/1998 | Joss et al. | 200/303 |
| 6,158,867 | A * | 12/2000 | Parker et al. | 362/29 |
| 7,041,924 | B2 * | 5/2006 | Jeschke et al. | 200/302.2 |
| 7,050,292 | B2 * | 5/2006 | Shimura et al. | 361/679.01 |
| 7,087,847 | B2 * | 8/2006 | Parkinson et al. | 200/5 A |
| 7,705,255 | B2 * | 4/2010 | Yokote | 200/302.2 |
| 7,764,936 | B2 * | 7/2010 | Nakasono et al. | 455/128 |
| 7,804,034 | B2 * | 9/2010 | Herzog et al. | 200/296 |
| 2003/0160669 | A1 | 8/2003 | Trandafir | |
| 2004/0200709 | A1 | 10/2004 | Sugimoto et al. | |

FOREIGN PATENT DOCUMENTS

| | | |
|---|---|---|
| DE | 41 11 680 | 10/1992 |
| DE | 196 51 821 | 6/1998 |
| DE | 103 08 204 | 2/2004 |
| DE | 103 09 823 | 9/2004 |
| EP | 1 645 679 | 4/2006 |
| JP | 2005-21602 | 1/2005 |

* cited by examiner

CONTROL UNIT FOR A HOUSEHOLD APPLIANCE

BACKGROUND OF THE INVENTION

The invention relates to a control unit for a domestic appliance, especially for a washing machine of the type specified in the pre-characterizing clause of claim 1.

A control unit of this kind is, for example, already known from DE 103 08 204 B3, with a control button, indicator or similar arranged within a panel opening of a fascia panel. At a distance behind the fascia panel or control buttons or indicators or similar, a board is arranged that serves to hold at least one electrical or electronic component. In order to protect the at least one electrical or electronic component against water entering via the fascia panel, a sealing element formed as a sealing layer is arranged between this and the board. The sealing element is directly attached to the board by a plurality of attaching areas that are provided between, or outside, the electrical or electronic components.

A disadvantage with an arrangement of this kind of sealing element is, however, that the board has to be of relatively large construction in order to be able to attach the sealing element over the attaching areas. In other words, the individual electrical or electronic components can only be arranged on the board at a relatively large distance from each other because board areas have to be provided between these at which the sealing element can be attached. Something else that must also be regarded as disadvantageous is the fact that water entering via the fascia panel or between this and the control buttons, indicators or similar has to be led out of the area between the mounting panel and sealing element in a relatively complicated manner, by means of drain openings arranged within the sealing element.

A further control unit is known from DE 10 2004 048 755 A1. Opposite a housing that carries a circuit board holding several micro switches, an assembly is mounted that itself includes a front wall and rear wall serving as fascia panels. Both the front wall and the rear wall are each pierced by openings through which switch plungers to operate the respective micro switches project. The front wall and rear wall of the control elements are furthermore arranged at a considerable distance from each other in the area of which a sealing element in the form of resilient sealing mat with through openings for the plungers is arranged. The sealing mat also lies flat, flush against the inner surface of the front wall. Furthermore, the sealing mat is in contact with the outer circumference of the corresponding plunger forming a tight seal over a corresponding length. Each plunger is surrounded at the rear wall end by a cap which is assigned to the sealing mat. The sealing mat is thus supported by resting on the inner surface of the back of the fascia panel against the rear wall.

A disadvantage of this known control unit is the fact that it is extraordinarily difficult to seal in the area of the plunger. This is especially due to the fact that in each case there has to be a mechanical decoupling between each two adjacent plungers by means of a suitable shaping so that when one of the buttons on the front assigned to the respective plunger is pressed the adjacent plunger is moved with it. Due to the corresponding loose arrangement of the sealing mat required on the inner surface of the front wall serving as a fascia panel, it is therefore possible that water can penetrate into the space between the front and rear wall. For this reason, a water drain has to be provided in the area between the front and rear wall on the one hand and on the other hand it is necessary for the sealing element to be correspondingly reliably sealed with respect to the plungers. Both methods incur significant production costs.

BRIEF SUMMARY OF THE INVENTION

The object of this present invention is therefore to improve a control unit of the type mentioned in the introduction in such a way that the electrical and/or electronic components can be arranged closer to each other and/or the board can be of more compact construction and the control unit overall can be less expensive to manufacture.

This object is achieved according to the invention by a control unit with the features of claim 1. Advantageous embodiments of the invention are specified in the remaining claims.

So that the board can be of a more compact or smaller construction and the control unit overall less expensive to manufacture, it is provided according to the invention that the sealing element is attached to the fascia panel of the control unit itself. In other words, it is thus provided according to the invention that the sealing element, in contrast to the previously known prior art, is not attached to the board but instead to the fascia panel arranged opposite it or at a distance from it. Therefore, there is no longer any need to provide an area on the board to which the sealing element can be attached. Because of this it is possible to arrange the individual electrical and/or electronic components of the board very much closer together and therefore make the board overall more compact A further advantage of the inventive arrangement of the sealing element is that especially water that occurs between the control buttons, indicators or similar and the fascia panel can be prevented from entering into the intermediate space between the board and the fascia panel, so that no measures need to be provided within the sealing element or control unit to drain water entering into the intermediate space.

A further advantage of the inventive attaching of the sealing element is that the said sealing element can be removed together with the fascia panel and/or the control buttons, indicators or similar assigned to it, thus affording direct access to the board and to the electrical and/or electronic components. This makes it extremely easy to access the board and the electrical and electronic components for repair purposes without the sealing element having to be removed from the board beforehand.

Overall, it can therefore be seen that a clearly more compact board and a control unit that is far less expensive to construct can be realized.

In a further embodiment of the invention it has also been shown to be advantageous if the sealing element is held against the fascia panel by a retaining frame. A retaining frame of this kind enables the otherwise extremely flexible sealing element to be very easily attached to the fascia panel. If the retaining frame is arranged on the side of the sealing element facing away from the fascia panel, this can be very easily removed from, or fitted to, the fascia panel by means of the retaining frame.

In a further embodiment of the invention it has also been shown to be advantageous if the retaining frame is joined to an edge side of the sealing element. This can create a sealing element with a particularly stable edge side, and the individual frame sections of the retaining frame can be arranged in an area that is outside the individual electrical and electronic components and therefore hardly interferes with them.

Furthermore, the sealing element or its retaining frame can be simply attached to the fascia panel by welding or bonding.

Such a welded or bonded joint provides an extremely reliable attachment of the sealing element to the fascia panel.

A further advantage of the sealing element being attached to the fascia panel of the control unit is that the control buttons, indicators or similar can be held by this inside the panel opening of the fascia panel. Additional attaching or positioning means for the control buttons, indicators or similar can thus be omitted. Due to the close proximity of the sealing element directly on the fascia panel, it is furthermore ensured that the control buttons, indicators or similar are arranged with a correspondingly uniform gap within the associated panel opening of the fascia panel.

A particularly simple embodiment of the control buttons, indicators or similar can furthermore be realized in that these are formed by the sealing element itself.

In a further embodiment of the invention, an optical fiber is integrated into the sealing element. In this way, it is, for example, easily possible to transmit a monitoring signal or monitoring light from a light source, especially an LED mounted on the board, to an area of the fascia panel visible from outside.

If the sealing element has at least one tappet part projecting in the direction of the board by means of which an associated button, switch or similar of the electrical and/or electronic components arranged on the board can be actuated, a particularly simple connection is established between an operating button arranged inside the fascia panel and a button, switch or similar arranged on the board.

As a sealing element, a silicone mat has been shown to be especially advantageous because this not only has an appropriate sealing quality but also an elastic resilience, so that the control buttons, indicators or similar can be carried directly on the silicone mat.

In a further embodiment of the invention, the sealing element has particularly resilient areas that are preferably arranged under a gap between the fascia panel and the respective control button, indicator or similar. By means of the resilient areas, it is thus easily possible to arrange the control buttons, indicators or similar within the associated panel openings of the fascia panel so that they are reversibly resetting.

In a further embodiment of the invention, a further seal is provided between the fascia panel and the control button, indicator or similar, which preferably is arranged on the side of the fascia panel facing away from the sealing element. This makes it easily possible to protect the gap between the fascia panel and the control button, indicator or similar against the ingress of water, dirt or dust.

BRIEF DESCRIPTION OF THE DRAWINGS

Further advantages, features and details of the invention are given in the following description of a preferred exemplary embodiment, and with reference to the drawing.

This shows a schematic section view of a control unit for a washing machine with a fascia panel that is accessible from outside for operation of the washing machine being arranged at a distance from a board carrying several electrical and/or electrical components, which has control buttons, indicators or similar arranged within the associated panel openings, with a sealing element attached to the fascia panel side between the fascia panel and the board being discernible.

DETAILED DESCRIPTION OF THE PRESENT INVENTION

Figure 1:
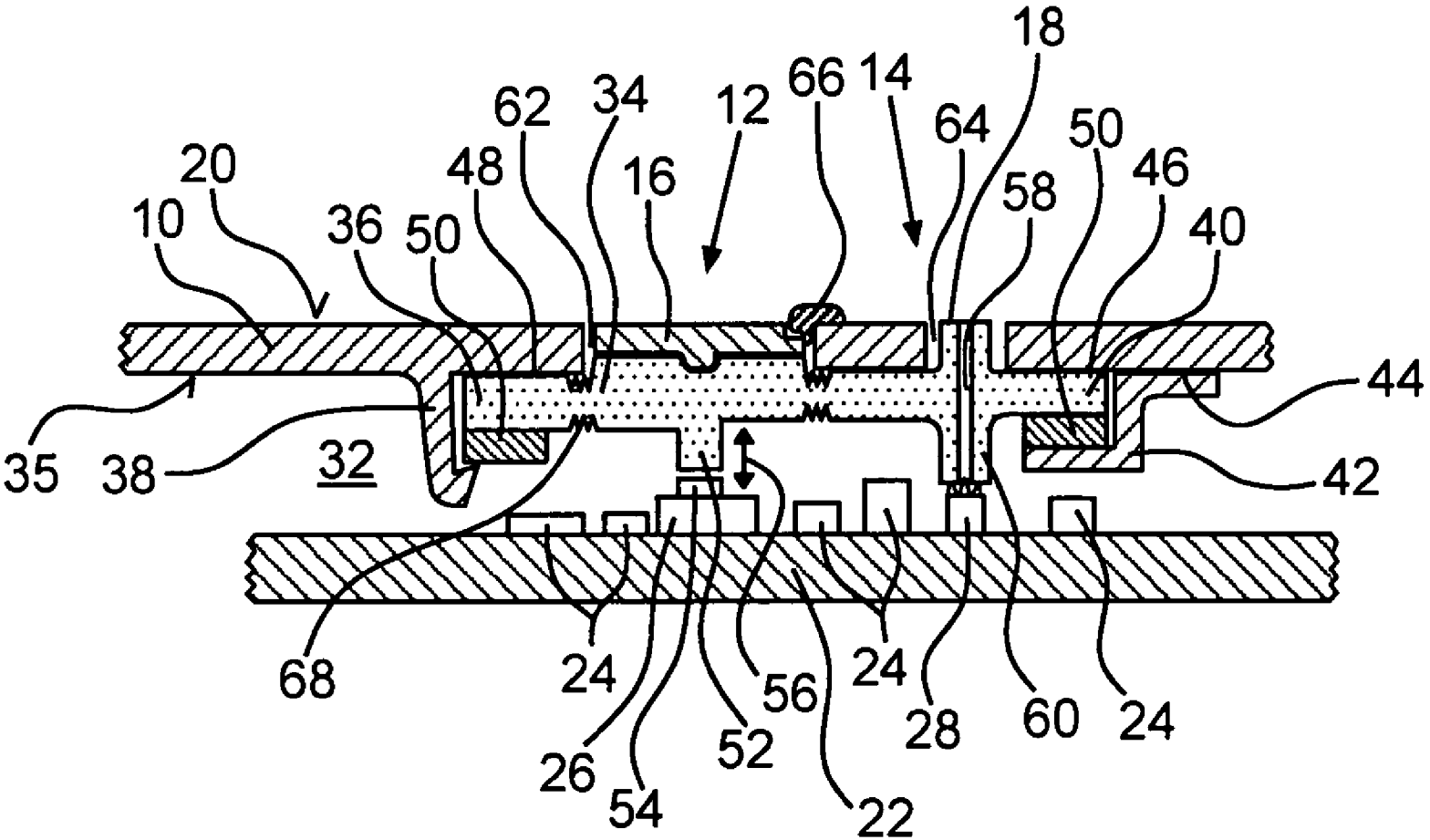

The illustration shows a section of an externally accessible fascia panel 10 of a control unit of a domestic appliance, in this case embodied as a washing machine, in which in this case two panel openings 12, 14 have been cut. The one panel opening 12 serves as a mounting for a control button 16 with the other panel opening 14 being provided as a mounting for an indicator 18. It can be seen that both the control button 16 and the indicator 18 are approximately level or flat with the front face 20 of the fascia panel 10 at the front.

Furthermore, the control unit has a board 22 arranged at a distance behind the fascia panel 10, that is used for mounting or holding electrical and/or electronic components 24, 26, 28, explained in more detail later, for closed- or open-circuit control of the washing machine. The individual components 24, 26, 28 can furthermore be preferably connected to each other via the board 22. It would of course be equally conceivable for the components 24, 26, 28 to be connected to each other or to other components by means of separately routed leads. It can also be seen from the illustration that the components 24, 26, 28 are arranged on the front 30 of the board 22 facing the fascia panel 10.

In an intermediate space 32 between the fascia panel 10 and the board 22, a sealing element 34 is arranged that is formed in this case as a silicone mat. It would be, of course, equally conceivable for the sealing element 34 to be made from a different material, preferably a resilient plastic material. Furthermore, it can also be seen from the illustration that the sealing element 34 is arranged or attached on an inner side 35 of the fascia panel 10. The attachment of the sealing element 34 is, for example, by means of a latching means 38, as can be seen on a left edge side 36 of the sealing element 34. An alternative attachment of the sealing element 34 at a right edge side 40 of the sealing element 34 is by means of a retaining part 42 that is in turn attached to the area of a connecting point 44 by means of a welded or bonded joint. Ultrasound welding is particularly suitable for connecting the components. It is equally conceivable for the sealing element 34 to be attached directly to the inside 35 of the fascia panel 10 over connecting areas 46, 48 which here run close to the edge sides 36, 40. In this case also common welding or bonding methods are particularly suitable.

In this present exemplary embodiment, the sealing element 34 is held on the fascia panel 10 by a retaining frame 50 whose frame profiles are arranged inside the edge sides 36, 40 or on the side of the sealing element 34 facing away from the fascia panel 10. The retaining frame 50 in this case, for example, is joined to the sealing element 34 by welding or bonding to form a unit. Naturally, it would be equally conceivable to arrange the retaining frame 50 loosely behind the sealing element 34

In the area of the left edge side 36 of the sealing element 34 it can be seen that both the retaining frame 50 and also the sealing element 34 are attached to the fascia panel 10 by means of a latching means 38. It can also be seen that the right edge side 40 of the sealing element 34 is attached to the fascia panel 10 by means of the retaining part 42. Furthermore, the retaining frame 50 can also be joined to the retaining part 42 by welding or bonding.

The control button 16 is attached to the fascia panel 10 inside the associated panel opening 12 by means of the sealing element 34. On the side facing away from the control button 16, the sealing element 34 has a raised tappet part 52 projecting in the direction of the board 22, by means of which a button 54 of the associated electric and/or electronic component 26 can be actuated. As can be seen by the arrow 56, an actuation of the control button 16 accordingly actuates the button 54 of the electric and/or electronic component 26. In other words, a press of the control button 16 is thus transmitted via the tappet part 52 to the associated electric and/or electronic component 26. After the control button 16 has been actuated it returns, as shown symbolically by the arrow 56, to its illustrated starting position in which it is flush with the associated front 20 of the fascia panel 10, due to the reversibility of the resilient sealing element 34.

The indicator 18, that can be seen from outside, is in this case formed by the sealing element 34 itself. Furthermore, an optical fiber 58 that extends from the front 20 of the fascia panel 10 to the rear end of the sealing element 34 close to an LED 28 is integrated into the sealing element 34. For this purpose, the sealing element 34 has another tappet part 60 that ends close to the LED 28. It can be seen that a light signal from the LED diode 28 leads to a corresponding light signal of the indicator 18 via the optical fiber 58.

A circumferential gap 62, 64 is formed between the fascia panel 10 and each control button 16 or indicator 18 integrated into the respective panel openings 12, 14, which gap, as can be seen on the right edge side of the control button 16, can be sealed by a seal 66. This avoids the ingress of water, dirt or dust into the respective gap 62, 64.

From the illustration, it can also be seen that the sealing element 34 includes flexible areas 68 behind the gap 62 between the control button 16 and the fascia panel 10 which are in this case formed by notches in the material. This enables the flexibility of the sealing element 34 to be increased in the area of the control button 16, so that it can easily be reversibly actuated. In other words, because of this it is possible to weaken an otherwise relatively stiff and accordingly resistant sealing element 34 in places so that a simple actuation of the control button 16 can be realized Overall it can thus be seen that due to the sealing element 34 the board 22 or the electrical and/or electronic components 24, 26, 28 mounted on it are protected against water or similar entering through the fascia panel 10. Furthermore, in the area of the respective gap 62, 64 between the fascia panel 10 and the control button 16 or the indicator 18 a further seal 66 is provided that, for example, is arranged on the side of the fascia panel 10 facing away from the sealing element 34, so that, furthermore, the ingress of water, dirt or dust into the respective gap 62, 64 is avoided. Furthermore, it can be seen that the sealing element 34 can be removed complete with the fascia panel 10 so that the electrical and/or electronic components 24, 26, 28 on the board 22 are readily accessible. This results in a control unit that is essentially more repair friendly.

The invention claimed is:

1. A control unit for a domestic appliance, comprising:

a fascia panel having a panel opening, the panel opening of the fascia panel being configured for associating therewith at least one control button, indicator, or other indicia related element;

a board for mounting at least one electrical or electronic component arranged at a distance behind the fascia panel; and a sealing element arranged between the fascia panel and the board, the sealing element being secured to the fascia panel to form a unit, and the sealing element operating to protect the at least one electrical or electronic component against water or another flowable substance, wherein the at least one control button, indicator, or other indicia related element is at least partly formed by the sealing element, and wherein the sealing element does not include an opening or through hole.

2. The control unit as claimed in claim 1, further comprising a retaining frame joined to the sealing element to form a unit, wherein the sealing element is attached to the fascia panel by means of the retaining frame.

3. The control unit as claimed in claim 2, wherein the retaining frame is arranged on the side of the sealing element facing away from the fascia panel.

4. The control unit as claimed in claim 2, wherein the retaining frame is connected to an edge side of the sealing element, the retaining frame having a lateral edge that extends at most to a lateral edge of the sealing element.

5. The control unit as claimed in claim 1, wherein the side of the fascia panel facing towards the board is provided with a latch to which the sealing element or its retaining frame is attached.

6. The control unit as claimed in claim 1, wherein the sealing element or its retaining frame is attached to the fascia panel by a welded or bonded joint.

7. The control unit as claimed in claim 1, wherein the at least one control button, indicator, or other indicia related element is held within the panel opening of the fascia panel by means of the sealing element.

8. The control unit as claimed in claim 1, wherein an optical fiber is integrated into the sealing element.

9. The control as claimed in claim 8, wherein a light source is provided behind the optical fiber.

10. The control as claimed in claim 9, wherein the light source comprises an LED as an electrical or electronic component arranged on the board.

11. The control unit a as claimed in claim 1, wherein the sealing element has at least one tappet part projecting in the direction of the board with which a button, switch or similar item of the electrical or electronic component arranged on the board can be actuated.

12. The control unit as claimed in claim 1, wherein the sealing element is embodied as a silicone mat.

13. The control unit as claimed in claim 1, wherein the sealing element has flexible areas which are preferably arranged behind a gap between the fascia panel and the at least one control button, indicator, or other indicia related element.

14. The control unit as claimed in claim 1, wherein another seal is provided between the fascia panel and the at least one control button, indicator, or other indicia related element, the other seal being provided in a gap formed between a lateral side of the opening and a lateral side of the control button indicator or other indicator related element.

15. The control unit as claimed in claim 14, wherein the other seal is arranged on the side of the fascia panel facing away from the sealing element.

16. The control unit as claimed in claim 1, further comprising a retaining frame to attach the sealing element to the fascia panel, and a latch to which the sealing element and the retaining frame are attached.

17. The control unit as claimed in claim 1, wherein the at least one control button and the indicator are formed by the sealing element.

18. The control unit as claimed in claim 1, wherein the indicator is formed by the sealing element, and an optical fiber or other light source is integrated into a hole provided along a longitudinal axis of the indicator.

19. The control unit as claimed in claim 1, wherein the sealing element extends at least partly into the panel opening of the fascia panel.

* * * * *